US009402497B1

(12) United States Patent
Covert

(10) Patent No.: US 9,402,497 B1
(45) Date of Patent: Aug. 2, 2016

(54) FEMALE BOXES SYSTEM

(71) Applicant: Kenneth Covert, Flanders, NJ (US)

(72) Inventor: Kenneth Covert, Flanders, NJ (US)

( * ) Notice: Subject to any disclaimer, the term of this patent is extended or adjusted under 35 U.S.C. 154(b) by 0 days.

(21) Appl. No.: 14/755,442

(22) Filed: Jun. 30, 2015

Related U.S. Application Data

(60) Provisional application No. 62/018,799, filed on Jun. 30, 2014.

(51) Int. Cl.
*A47G 29/122* (2006.01)
*E04H 12/22* (2006.01)

(52) U.S. Cl.
CPC ..... *A47G 29/1216* (2013.01); *E04H 12/2215* (2013.01); *E04H 12/2292* (2013.01)

(58) Field of Classification Search
CPC ..... A47G 29/1216; E04H 12/2215; E04H 12/2292; G09F 23/00; G09F 7/1804
USPC ..... 232/39; 248/146, 156; D99/32; 40/606.06
See application file for complete search history.

(56) References Cited

U.S. PATENT DOCUMENTS 3,667,405 A * 6/1972 Roach, Jr. ..... E04H 12/18 109/51
5,143,285 A 9/1992 Wise
5,190,214 A * 3/1993 Dewailly ..... G09F 7/00 232/39
5,903,991 A * 5/1999 Sasse ..... G09F 7/22 248/156
6,109,519 A * 8/2000 McClure ..... A47G 29/1216 232/17
6,308,884 B1 * 10/2001 Hamburger ..... A47G 29/1209 232/38
6,575,423 B2 6/2003 Erwin
D634,094 S * 3/2011 Benavidez ..... D99/30
2006/0102711 A1 * 5/2006 Stephens ..... A47G 29/1216 232/39

* cited by examiner

*Primary Examiner* — William Miller
(74) *Attorney, Agent, or Firm* — RG Patent Consulting, LLC; Rachel Gilboy

(57) ABSTRACT

A mail post removably-coupled to a mailbox system includes: a mail post removably-couplable to a mailbox assembly having a hollow and transparent mail post including a first open end having internal male threads, a least one item insertable into the hollow and transparent mail post via the first open end, and a second end having an end-cap; a connector for removably-coupling the mail post to a mailbox having a top surfacing mounting plate, and a hollow cylindrical collar including internal female threads coupled to the top surface mounting plate; the mailbox having a side wall, a flat base having a plurality of fasteners, a first end having a rotatable hinged door, a closed end, and a hollow shaped interior volume for collecting mail. The mail post removably-coupled to a mailbox system comprises said mail post removably-coupled to a mailbox assembly.

17 Claims, 5 Drawing Sheets

FEMALE BOXES SYSTEM

CROSS-REFERENCE TO RELATED APPLICATION

The present application is related to and claims priority from prior provisional application Ser. No. 62/018,799, filed Jun. 30, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of mailbox posts and more specifically relates to a mail post removably-coupled to a mailbox system.

2. Description of the Related Art

Rural Free Delivery—RFD as it is known to many—was the response over a century ago to the notion that rural Americans were as entitled to having mail brought to their homes as were their city-dwelling counterparts. After all, city dwellers had been getting their mail delivered by letter carriers since the Civil War, when Joseph Briggs, an Ohio postal clerk, proposed the idea because he could no longer bear watching wives and families receive the news of their war dead in the public domain of the post office.

Before RFD, Americans who lived in rural areas had to travel to the nearest post office to send and receive mail, and often these post offices were miles away. But rural mail delivery service frightened Congress, says Nancy Pope, a curator at the National Postal Museum. "Many deemed the nation too large and believed that such a service would bankrupt the country. It would require an infusion of cash from Congress, new roads and more postal employees to implement the service."

Congress took the leap, and Rural Free Delivery became a critically important means of linking farm families with the rest of the world. Beyond that, RFD became a major avenue of commerce, helping to establish the catalog-shopping era of Sears, Roebuck; J.C. Penney; Montgomery Ward, and others. The rural parcel post service, which allowed carriers to deliver packages and parcels along with the mail, offered a breakthrough for the nation's farmers, bringing them closer to the rest of the world through items such as mail-order catalogs, and catalog-ordered merchandise.

On another level, rural Americans began to receive newspapers and magazines, whereas before, all news was local. Being able to get a newspaper from a larger city, or a national magazine, brought them closer to the national pulse of the country. For the first time, farmers in North Dakota could read the same information as someone in the rural areas of Florida, or the avenues of New York City. Rural Free Delivery was also one of several factors that led to the good roads movement. The Post Office Department had the right to refuse mail delivery until the roads were repaired. Communities repaired their roads.

Now more than 100 years old, the service itself is better understood today than it was at its beginning. One early customer, not fully aware of a rural letter carrier's scope of service, left the carrier the following note: "Please feed our chickens and water the cows and the mule in the stable. And if the bees have swarmed, put them in a new hive. We have gone visiting."

Not much chance of a Rural Letter Carrier stopping to feed your chickens today, and the traffic along even our "rural" roads—cars, farm equipment, pick-ups, motorcycles—would make an early-20th century farmer's head spin. And yet, millions of Americans, both rural and suburban, walk out to their roadside mailbox once a day, open the box and see what the mail carrier has left them. The roadside mailbox is a daily fixture in the lives of millions of consumers; and one inventor, considering this utilitarian, commonplace receptacle, has conceived a means of brightening it up—making one's roadside mailbox not only useful, but attractive and personalized.

Various attempts have been made to solve problems found in mailbox post art. Among these are found in: U.S. Pat. No. 6,575,423 to Ronald D. Erwin; U.S. Pat. No. 5,143,285 to Brian E. Wise; and U.S. Pat. No. 5,190,214 to Richard J. Dewailly. This prior art is representative of mailbox posts. None of the above inventions and patents, taken either singly or in combination, is seen to describe the invention as claimed.

Ideally, a mail post removably-coupled to a mailbox system should be user-friendly and safe in-use and, yet may operate reliably and be manufactured at a modest expense. Thus, a need exists for mail post removably-coupled to a mailbox system provides a user with creating an attractive and personalized mail post removably-coupled to a mailbox assembly by enabling a user to decorate and re-decorate the mail post removably-coupled to a mailbox assembly for a distinctive, individualized home and landscaping accent such that an identity of a mail-receipt is readily known and to avoid the above mentioned problems.

BRIEF SUMMARY OF THE INVENTION

In view of the foregoing disadvantages inherent in the known mail post device art, the present invention provides a mail post removably-coupled to a mailbox system (entitled 'Female Boxes System'). The general purpose of the present invention, which will be described subsequently in greater detail is to provide a mail post removably-coupled to a mailbox system provides a user with creating an attractive and personalized mail post removably-coupled to a mailbox assembly by enabling a user to decorate and re-decorate the mail post removably-coupled to a mailbox assembly for a distinctive, individualized home and landscaping accent such that an identity of a mail-receipt is readily known.

A mail post removably-coupled to a mailbox system comprising: a mail post removably-couplable to a mailbox assembly having a hollow and transparent mail post including a first open end having internal male threads, a least one item insertable into the hollow and transparent mail post via the first open end, and a second end having an end-cap; a connector for removably-coupling the mail post to a mailbox having a top surfacing mounting plate, and a hollow cylindrical collar including external female threads coupled to the top surface mounting plate; the mailbox having a side wall, a flat base having a plurality of fasteners, a first end having a rotatable hinged door, a closed end, and a hollow shaped interior volume for collecting mail.

The mail post removably-coupled to a mailbox system comprises said mail post removably-coupled to a mailbox assembly. The mail post removably-coupled to a mailbox assembly provides a user with creating an attractive and personalized mail post removably-coupled to a mailbox assembly by enabling the user to decorate and re-decorate the mail post removably-coupled to a mailbox assembly for a distinctive, individualized home and landscaping accent such that an identity of a mail-receipt is readily known.

The hollow and transparent mail post, the connector, and the mailbox comprise the mail post removably-coupled to a mailbox assembly. The first open end, at least one item, and second end having an end-cap comprise the hollow and transparent mail post. The hollow and transparent mail post comprises at least one thermoplastic material for providing strength, durability, and weather-resistant properties to promote longevity in use. The hollow and transparent mail post is approximately 5-inches in diameter, and approximately 48-inches in length.

The second end having an end-cap of hollow and transparent said mail post prevents the at least one item from exiting out of the hollow and transparent mail post by preventing unwanted displacement of the at least one item. The second end of the hollow and transparent mail post is capped via the end-cap approximately 10-inches from the second end thereby forming a hollow bottom section of the hollow and transparent mail post. The at least one item insertable into said hollow and transparent mail post via said first open end comprises at least one sample work product for advertising a business. The hollow bottom section of the hollow and transparent mail post is structured and arranged to be mounted to a post that is anchored into a ground volume.

The external female threads located on the hollow cylindrical collar of the connector are mated with the internal male threads located at the first open end thereby allowing coupling of the connector to the mail post removably-coupled to a mailbox assembly. The mailbox is connected to the connector via the flat base. The flat base of the mailbox is coupled to the top surfacing mounting plate via the plurality of fasteners. The plurality of fasteners located on the flat base of the mailbox removably-couple the connectable collar to the mailbox The plurality of fasteners located on the flat base comprise threaded fasteners. The threaded fasteners comprise nuts and bolts. The side wall, the flat base having a plurality of fasteners, the first end having a rotatable hinged door, the closed end, and the hollow shaped interior volume comprise the mailbox. mailbox comprises wood to provide material strength, durability, and weather-resistance and is structured and arranged to meet US Postal service size requirements. The post that is anchored into said ground volume comprises wood.

The present invention holds significant improvements and serves as a Mail post removably-coupled to a mailbox system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention mail post removably-coupled to a mailbox system (entitled Female Boxes System) constructed and operative according to the teachings of the present invention.

The various embodiments of the present invention will hereinafter be described in conjunction with the appended drawings, wherein like designations denote like elements.

DETAILED DESCRIPTION

Figure 1:
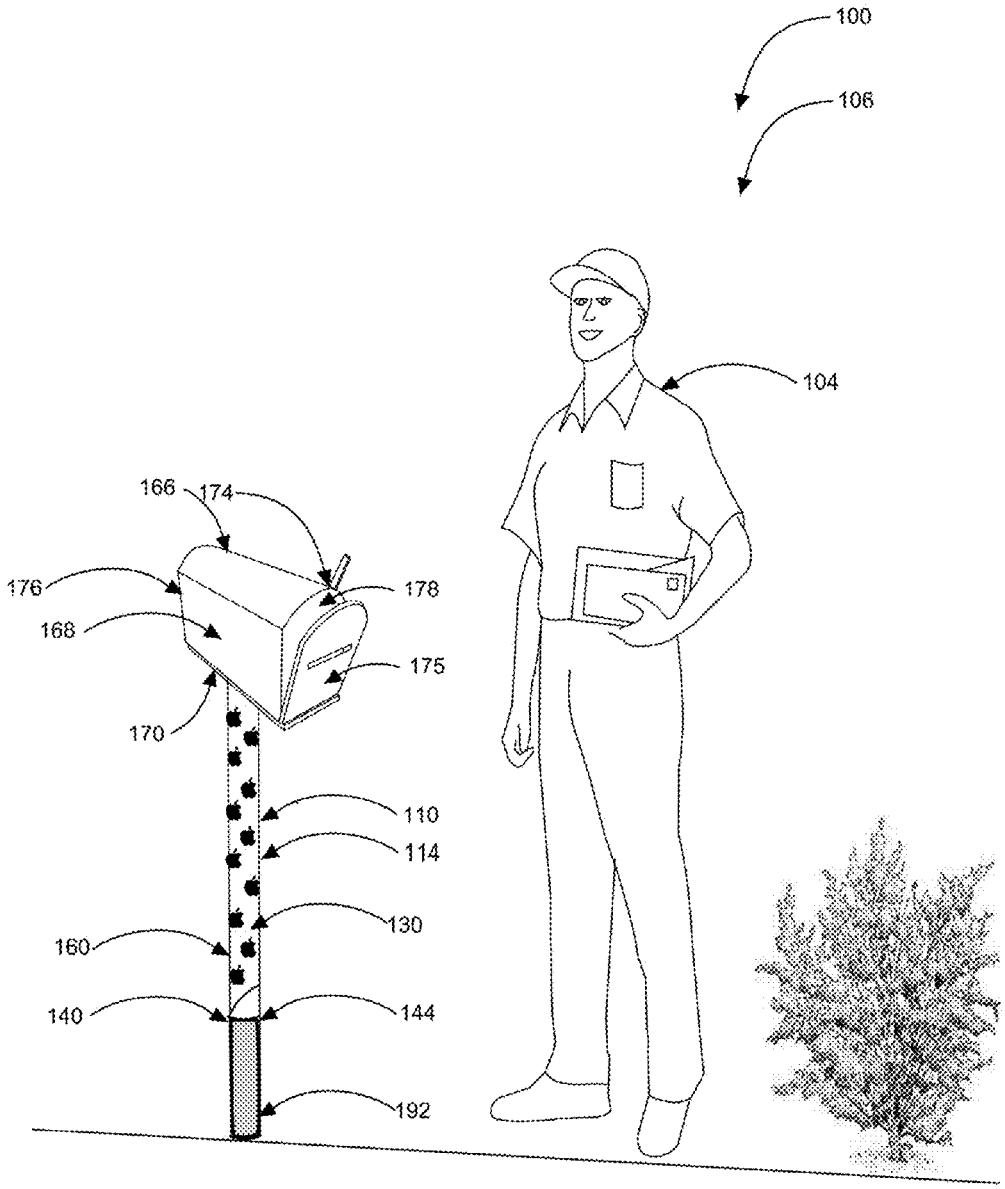
FIG. 1 shows a front perspective view illustrating a mail post removably-coupled to a mailbox system in an 'in-use' condition according to an embodiment of the present invention.

As discussed above, embodiments of the present invention relate to a mail post device and more particularly to a protective sheaths system (entitled Female Boxes System) provides a user with creating an attractive and personalized mail post removably-coupled to a mailbox assembly by enabling a user to decorate and re-decorate the mail post removably-coupled to a mailbox assembly for a distinctive, individualized home and landscaping accent such that an identity of a mail-receipt is readily known.

Generally speaking, the Female Boxes System comprises a specially designed would include a front-opening mailbox meeting the specifications of the US Postal Service. This mailbox may be fabricated in wood, or in longer-lasting stamped metal or molded thermoplastic.

The base of the mailbox is preferably pre-fitted to mount by nuts and bolts to a sturdy mounting collar. The base of the mounting collar is preferably cylindrical and its interior is preferably female-threaded to receive a cylindrical, hollow, transparent thermoplastic post or tube. The top of the transparent tube is preferably male-threaded to fasten to the mailbox mounting collar. The tube may be approximately 5-inches in diameter, and approximately 48-inches in length. The base of the tube is preferably capped approximately 1-inch above the bottom, and the hollow bottom section of the tube may be mounted on a wooden or metal post anchored in the ground.

The transparent post or tube of the Female Boxes System is preferably designed to enable consumers to personalize their mailbox. This may be accomplished by filling the tube with any materials or objects a user desire including but not limited to: dried or fresh flowers; pebbles from the beach; colored sand; stuffed animals; golf balls or tennis balls; colored glass; marbles; fishing lures; rubber chickens; colorful fabric remnants; debris recovered after storms—anything the user find attractive or amusing that can be poured, placed, or stuffed into the open-topped tube.

Once the tube has been filled with such items, the mailbox and collar are simply screwed back into place atop the tube. Thus, the consumer is able not only to decorate and personalize the Female Boxes System once, but to do so as often as the user desire. At Halloween, for example, a consumer might fill their Female Boxes System tube with brightly wrapped candies, or small plastic jack-o-lanterns; at Easter, with colorful plastic eggs; and at Christmas with a variety of ribbons, plastic ornaments, or perhaps candy canes, with a ribbon spiraled around the tube itself to complete the display. Small business owners may fill their Female Boxes System tubes in a similar, seasonal changing manner, or with samples of their wares.

The Female Boxes System may be easy and fun to assemble with a minimum of hand tools, and this innovative, personally expressive mailbox may give consumers the opportunity to add flair, color, and enjoyment to an essential, everyday object not generally associated with such qualities Families may decorate the Female Boxes together, refilling the box tube with festive objects and materials as the seasons change and holidays come and go. Clever in conception and thoughtful in design, the versatile, endlessly adaptable Female Boxes System preferably add zest and color to one's roadside mail receptacle—and do so at an eminently affordable price.

Figure 2:
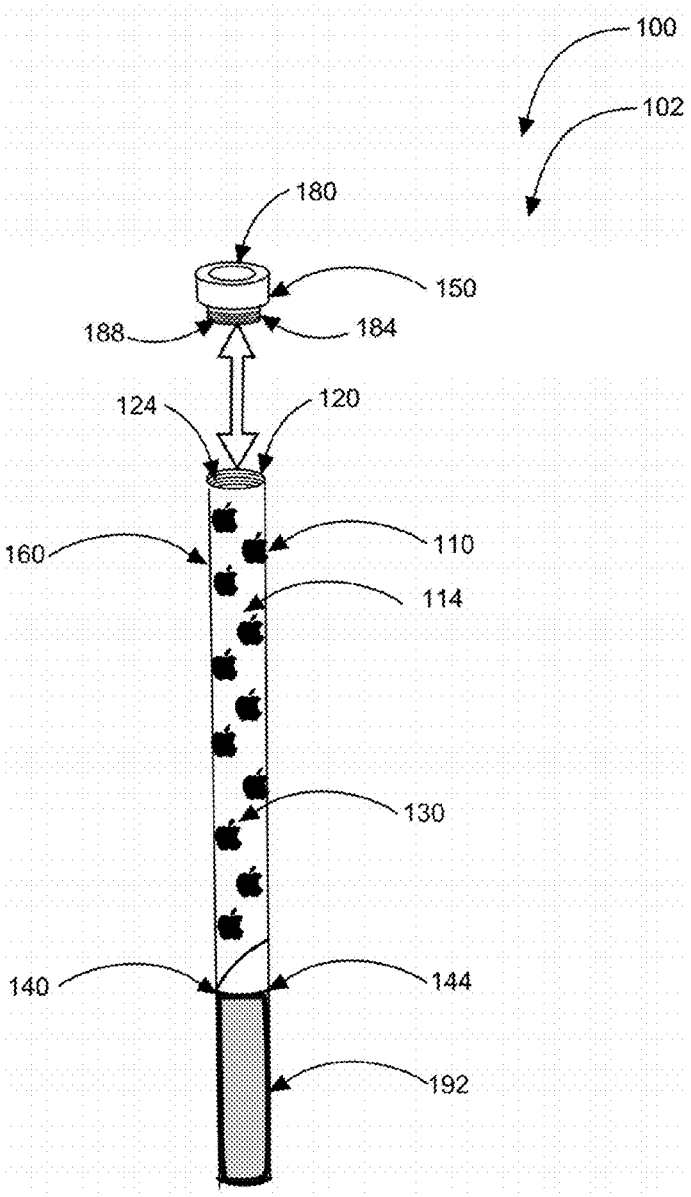
FIG. 2 shows a front perspective view illustrating a mail post removably-couplable to a mailbox assembly of the mail post removably-coupled to a mailbox system according to an embodiment of the present invention.
Figure 3:
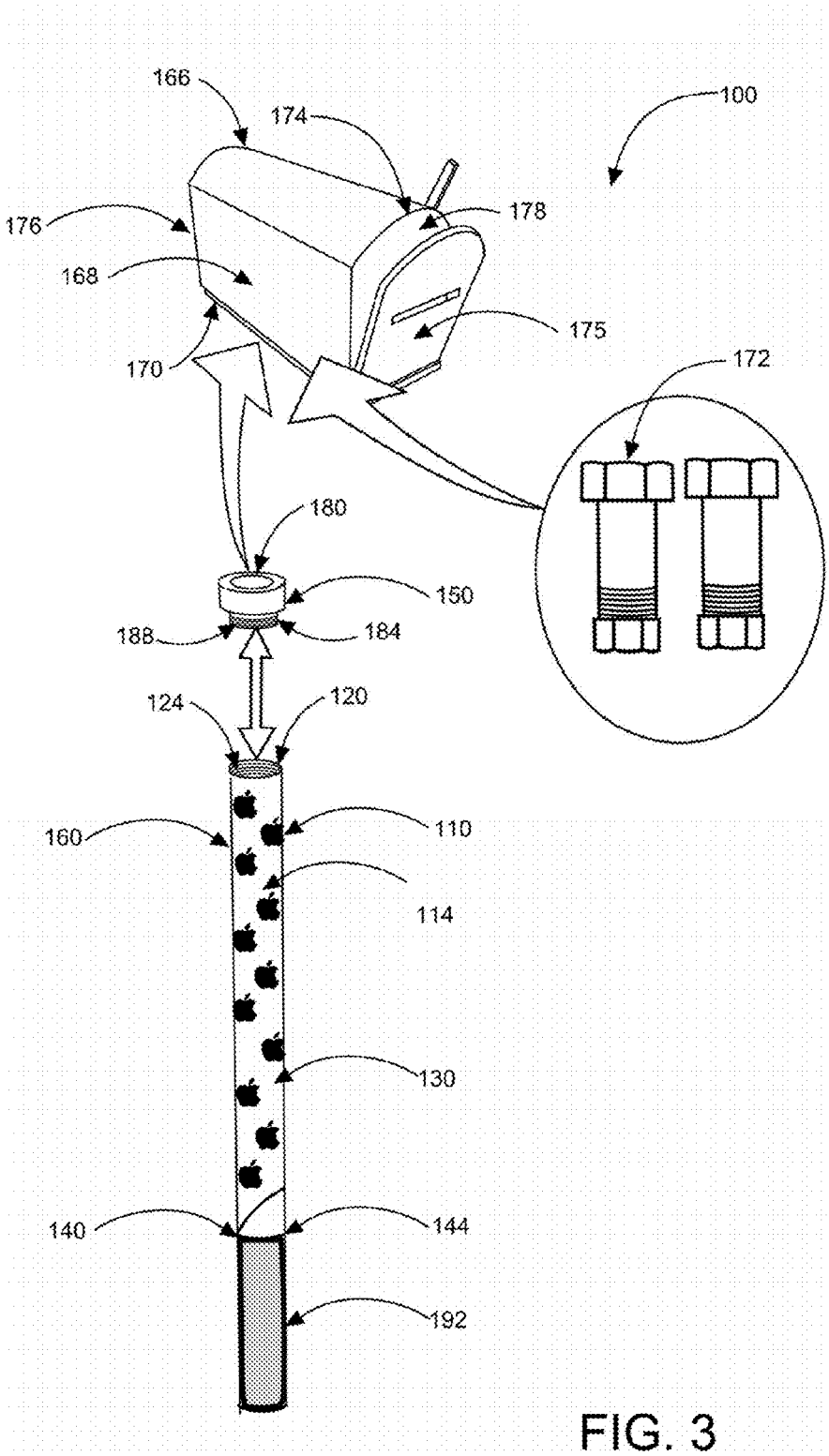
FIG. 3 is a perspective view illustrating a mail post removably-couplable to a mailbox assembly of the mail post removably-coupled to a mailbox system according to an embodiment of the present invention.

Referring now to the drawings by numerals of reference there is shown in FIGS. 1-3 perspective views illustrating mail post removably-couplable to a mailbox assembly 102 of mail post removably-coupled to a mailbox system 100 according to an embodiment of the present invention.

Mail post removably-coupled to a mailbox system 100 comprising: mail post removably-couplable to a mailbox assembly 102 having hollow and transparent mail post 110 including first open end 120 having internal male threads 124, at least one item 130 insertable into hollow and transparent mail post 110 via first open end 120, and second end 140 having end-cap 144; connector 150 for removably-coupling mail post 160 to mailbox 166 having top surfacing mounting plate 180, and hollow cylindrical collar 184 including external female threads 188 coupled to top surface mounting plate 180; mailbox 166 having side wall 168, flat base 170 having plurality of fasteners 172, first end 174 having rotatable hinged door 175, closed end 176, and hollow shaped interior volume 178 for collecting mail.

Mail post removably-coupled to a mailbox system 100 comprises mail post removably-coupled to mailbox assembly 102. Mail post removably-coupled to a mailbox assembly 102 provides user 104 with creating an attractive and personalized mail post removably-coupled to a mailbox assembly 102 by enabling the user to decorate and re-decorate the mail post removably-coupled to a mailbox assembly 102 for a distinctive, individualized home and landscaping accent such that an identity of a mail-receipt is readily known.

Hollow and transparent mail post 110, connector 150, and mailbox 166 comprise mail post removably-coupled to a mailbox assembly 102. First open end 120, at least one item 130, and second end 140 having end-cap 144 comprise hollow and transparent mail post 110. Hollow and transparent mail post 110 comprises at least one thermoplastic material for providing strength, durability, and weather-resistant properties to promote longevity in use. Hollow and transparent mail post 110 is approximately 5-inches in diameter, and approximately 48-inches in length.

Second end 140 having end-cap 144 of hollow and transparent mail post 110 prevents the at least one item 130 from exiting out of hollow and transparent mail post 110 by preventing unwanted displacement of at least one item 110. Second end 140 of hollow and transparent mail post 110 is capped via end-cap 144 approximately 10-inches from second end 140 thereby forming hollow bottom section 114 of hollow and transparent mail post 110. Hollow bottom section 114 of hollow and transparent mail post 110 is structured and arranged to be mounted to post 192 that is anchored into a ground volume. Post 192 that is anchored into the ground volume may comprise wood or a steel pipe.

At least one item 104 insertable into said hollow and transparent mail post via said first open end comprises at least one sample work product for advertising a business or at least one company logo for advertising a business as shown in in-use condition 106 of FIG. 1. At least one item 104 insertable into hollow and transparent mail post 110 via first open end 120 may also comprise at least one flower, sand, or seashells for example. At least one item insertable into hollow and transparent mail post 110 via first open end 120 comprises at least one theme. At least one theme 104 may include but is not limited to Christmas, Halloween, Fourth of July, Memorial Day, Thanksgiving, Easter, New Years Eve, a birthday, or an anniversary.

External female threads 188 located on hollow cylindrical collar 184 of connector 150 are mated with internal male threads 124 located at the first open end 120 thereby allowing coupling of connector 150 to mail post removably-coupled to a mailbox assembly 102. Mailbox 166 is connected to connector 150 via flat base 170. Flat base 170 of mailbox 166 is coupled to the top surfacing mounting plate 180 via plurality of fasteners 172. Plurality of fasteners 172 located on flat base 170 of mailbox 166 removably-couple connectable collar 184 to mailbox 166. Plurality of fasteners 172 located on flat base 170 comprise threaded fasteners. The threaded fasteners comprise nuts and bolts. Side wall 168, flat base 170 having plurality of fasteners 172, first end 174 having rotatable hinged door 175, closed end 176, and hollow shaped interior volume 178 comprise mailbox 166.

Mailbox 166 may comprise wood to provide material strength, durability, and weather-resistance and is structured and arranged to meet US Postal service size requirements. Upon reading this specification, it should be appreciated that, under appropriate circumstances, considering such issues as user preferences, design preference, structural requirements, marketing preferences, cost, available materials, technological advances, etc., other material arrangements such as, for example, longer-lasting stamped metal, a molded thermoplastic, etc., may be sufficient.

Figure 4:
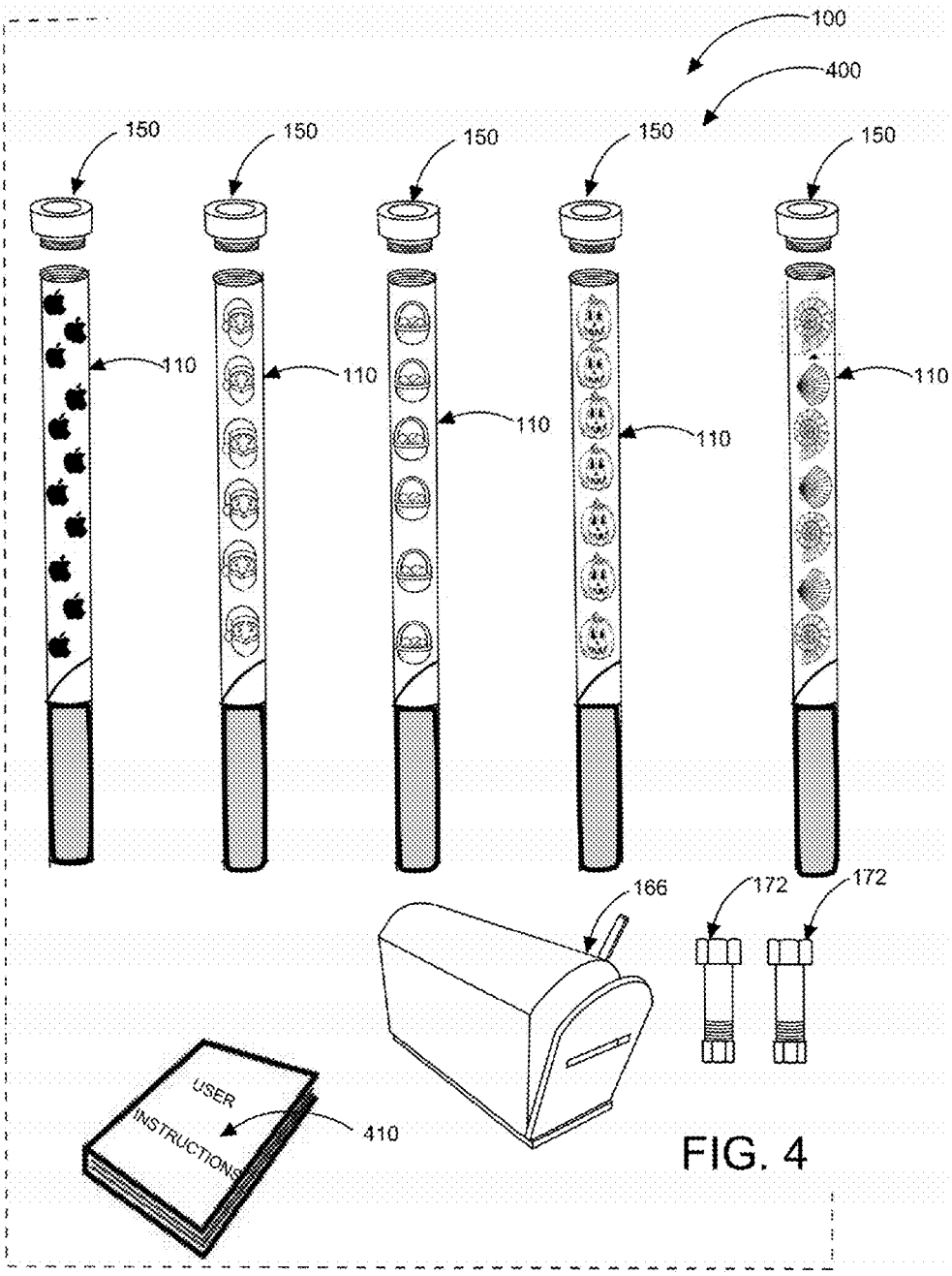
FIG. 4 is a perspective view illustrating a kit of mail post removably-coupled to a mailbox system according to an embodiment of the present invention.

Referring now to FIG. 4 showing a perspective view illustrating kit 400 of mail post removably-coupled to a mailbox system 100 according to an embodiment of the present invention of FIG. 1

Kit 400 is embodied herein for mail post removably-coupled to a mailbox system 100 comprising mail post removably-coupled to a mailbox system comprising a mail post removably-couplable to a mailbox assembly including a plurality of hollow and transparent mail posts, at least one connector, an optional mailbox, nut and bolt threaded fasteners, and a set of user-instructions.

Kit 400 has instructions such that functional relationships are detailed in relation to the structure of the invention (such that the invention can be used, maintained, or the like in a preferred manner). Mail post removably-coupled to a mailbox system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
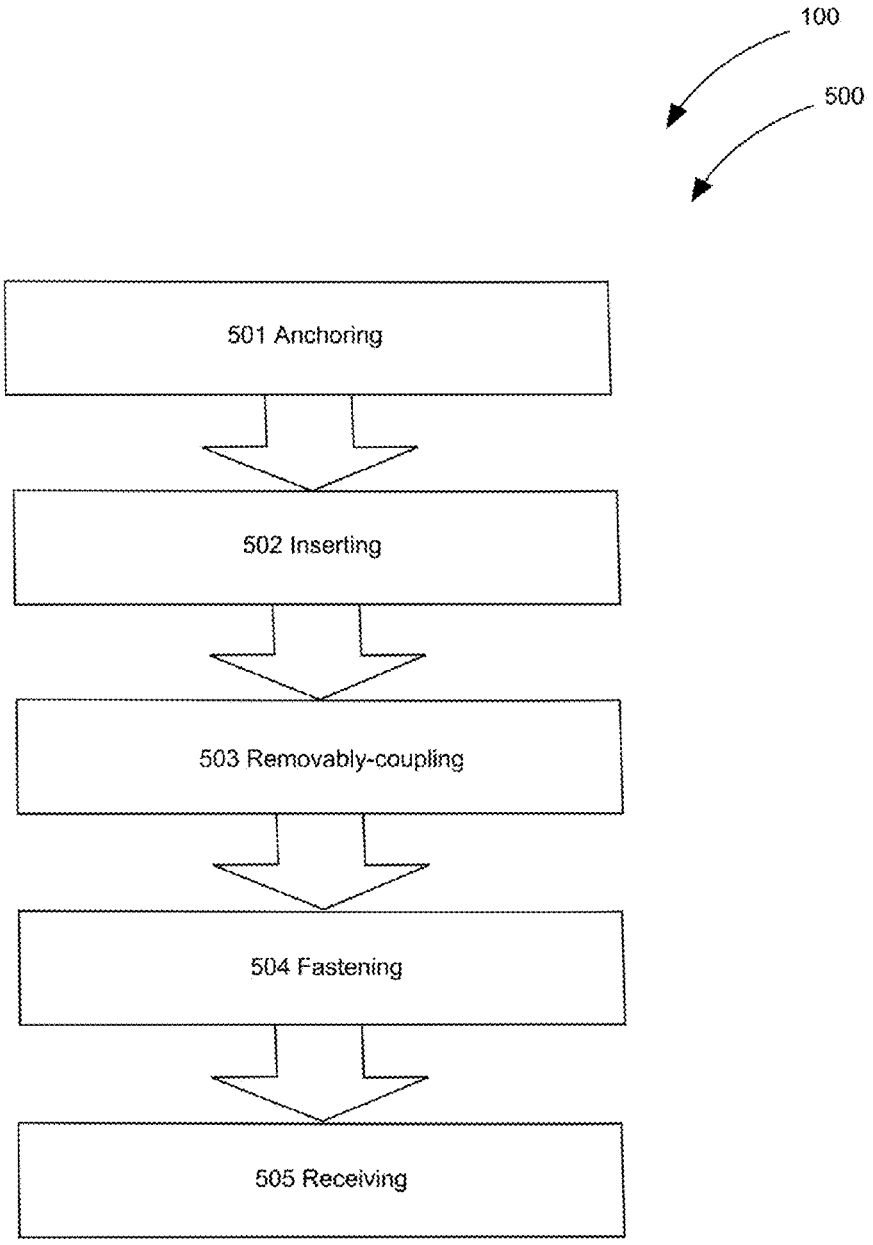
FIG. 5 is a flowchart illustrating a method of use for the mail post removably-coupled to a mailbox system according to an embodiment of the present invention of FIGS. 1-4.

Referring now to FIG. 5, flowchart 550 illustrating method of use 500 for mail post removably-coupled to a mailbox system 100 according to an embodiment of the present invention of FIGS. 1-4.

Method of using protective sheaths system 100 comprises the steps of: step one 501 anchoring a post coupled to a hollow and transparent mail post into a ground volume; inserting said hollow and transparent mail post with a user-preferred at least one item via a first open end; removably-coupling a connector having internal female threads to internal male threads on first open end thereby preventing unwanted displacement of at least one item; fastening a user-preferred mailbox onto a top surface mounting plate located on said connector via a plurality nut and bolt threaded fasteners thereby forming said mail post removably-couplable to a mailbox assembly; and a user receiving and retrieving mail from a mail carrier.

It should be noted that the steps described in the method of use can be carried out in many different orders according to user preference. The use of "step of" should not be interpreted as "step for", in the claims herein and is not intended to invoke the provisions of 35 U.S.C. §112, 16. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A mail post removably-coupled to a mailbox system comprising:

a hollow and transparent mail post including,
- a first open end having internal male threads,
- at least one item insertable into said hollow and transparent mail post via said first open end, and
- a second end having an end-cap;

a connector for removably-coupling said mail post to a mailbox having,
- a top surfacing mounting plate, and
- a hollow cylindrical collar including external female threads coupled to said top surface mounting plate;

said mailbox having,
- a side wall,
- a flat base having a plurality of fasteners,
- a first end having a rotatable hinged door,
- a closed end, and
- a hollow shaped interior volume for collecting mail;

wherein said end-cap prevents said at least one item from exiting out of said hollow and transparent mail post by preventing unwanted displacement of said at least one item;

wherein said second end of said hollow and transparent said mail post is capped via said end-cap approximately 10-inches from said second end thereby forming a hollow bottom section of said hollow and transparent said mail post;

wherein said hollow bottom section of said hollow and transparent said mail post is structured and arranged to be mounted to a post that is anchored into a ground volume;

wherein said external female threads located on said hollow cylindrical collar are mated with said internal male threads located on said hollow and transparent mail post thereby allowing coupling of said connector to said mail post;

wherein said mailbox is connected to said connector via said flat base;

wherein said flat base of said mailbox is coupled to said top surfacing mounting plate via said plurality of fasteners;

wherein said plurality of fasteners located on said flat base of said mailbox removably-couple said connectable collar to said mailbox; and wherein said mail post removably-coupled to said mailbox provides a user with creating an attractive and personalized mail post removably-coupled to said mailbox by enabling said user to decorate and re-decorate said mail post for a distinctive, individualized home and landscaping accent.

2. The mail post removably-coupled to a mailbox system of claim 1 wherein said hollow and transparent mail post comprises at least one thermoplastic material for providing strength, durability, and weather-resistant properties to promote longevity in use.

3. The mail post removably-coupled to a mailbox system of claim 1 wherein said hollow and transparent mail post is approximately 5-inches in diameter, and approximately 48-inches in length.

4. The mail post removably-coupled to a mailbox system of claim 1 wherein said at least one item insertable into said hollow and transparent mail post via said first open end comprises at least one company logo for advertising a business.

5. The mail post removably-coupled to a mailbox system of claim 1 wherein said at least one item insertable into said hollow and transparent mail post via said first open end comprises at least one sample work product for advertising a business.

6. The mail post removably-coupled to a mailbox system of claim 1 wherein said at least one item insertable into said hollow and transparent mail post via said first open end comprises at least one flower.

7. The mail post removably-coupled to a mailbox system of claim 1 wherein said at least one item insertable into said hollow and transparent mail post via said first open end comprises sand.

8. The mail post removably-coupled to a mailbox system of claim 1 wherein said at least one item insertable into said hollow and transparent mail post via said first open end comprises at least one theme.

9. The mail post removably-coupled to a mailbox system of claim 8 wherein said at least one theme comprises Christmas.

10. The mail post removably-coupled to a mailbox system of claim 8 wherein said at least one theme comprises Easter.

11. The mail post removably-coupled to a mailbox system of claim 8 wherein said at least one theme comprises Halloween.

12. The mail post removably-coupled to a mailbox system of claim 1 where said plurality of fasteners located on said flat base comprise threaded fasteners.

13. The mail post removably-coupled to a mailbox system of claim 12 where said threaded fasteners comprise nuts and bolts.

14. The mail post removably-coupled to a mailbox system of claim 1 where said mailbox comprises wood.

15. The mail post removably-coupled to a mailbox system of claim 1 wherein said post that is anchored into said ground volume comprises wood.

16. The mail post removably-coupled to a mailbox system of claim 1 wherein said post that is anchored into said ground volume comprises a steel pipe.

17. A method of using a mail post removably-coupled to a mailbox system comprising the steps of:

anchoring a post coupled to a hollow and transparent mail post into a ground volume;

inserting said hollow and transparent mail post with at least one item via a first open end thereof;

removably-coupling a connector having external female threads to internal male threads on said first open end thereby preventing unwanted displacement of said at least one item;

fastening a mailbox onto a top surface mounting plate located on said connector via a plurality of nut and bolt threaded fasteners; and a user receiving and retrieving mail from a mail carrier.

* * * * *